US009051761B2

(12) United States Patent
Romero

(10) Patent No.: US 9,051,761 B2
(45) Date of Patent: Jun. 9, 2015

(54) MANUALLY DRIVEN ELECTRONIC DEADBOLT ASSEMBLY WITH FIXED TURNPIECE

(75) Inventor: Oscar Romero, Lake Forest, CA (US)

(73) Assignee: Kwikset Corporation, Foothill Ranch, CA (US)

( * ) Notice: Subject to any disclaimer, the term of this patent is extended or adjusted under 35 U.S.C. 154(b) by 122 days.

(21) Appl. No.: 13/559,949

(22) Filed: Jul. 27, 2012

(65) Prior Publication Data

US 2013/0031940 A1 Feb. 7, 2013

Related U.S. Application Data

(60) Provisional application No. 61/514,192, filed on Aug. 2, 2011.

(51) Int. Cl.

| | |
|---|---|
| ***E05B 49/00*** | (2006.01) |
| ***E05B 37/00*** | (2006.01) |
| ***E05B 47/06*** | (2006.01) |
| ***E05B 13/00*** | (2006.01) |
| *E05B 47/00* | (2006.01) |

(52) U.S. Cl.

CPC ..... *E05B 37/00* (2013.01); *E05B 47/0012* (2013.01); *E05B 47/0661* (2013.01); *E05B 13/004* (2013.01); *E05B 2047/0054* (2013.01); *E05B 2047/0058* (2013.01)

(58) Field of Classification Search

CPC ..... E05B 43/005; E05B 47/0012; E05B 47/0005; E05B 47/0002; E05B 47/063; E05B 47/0603; E05B 47/0619; E05B 47/0676; E05B 47/068; E05B 2047/00; E05B 2047/0001; E05B 2047/0012; E05B 2047/0014; E05B 2047/0017; E05B 2047/0018; E05B 2047/0026; E05B 2047/0048; E05B 2047/0054; E05B 2047/0091

USPC ..... 70/149, 188, 189, 218, 222, 223, 278.1, 70/278.7, 283, 471, 472, 473

See application file for complete search history.

(56) References Cited

U.S. PATENT DOCUMENTS

| | | | |
|---|---|---|---|
| 2,942,907 | A | 6/1960 | Nagel et al. |
| D206,373 | S | 12/1966 | James et al. |
| 3,529,454 | A | 9/1970 | Fish |

(Continued)

FOREIGN PATENT DOCUMENTS

| | | | |
|---|---|---|---|
| CN | 101162640 | A | 4/2008 |
| CN | 101409132 | A | 4/2009 |

(Continued)

*Primary Examiner* — Christopher Boswell

(74) *Attorney, Agent, or Firm* — Barnes & Thornburg LLP

(57) ABSTRACT

An exterior actuator assembly for a manually driven electronic deadbolt assembly includes a torque blade driver having a perimetrical lock recess, and is rotatable about a first rotational axis. A clutch assembly is drivably interposed between an exterior turnpiece and the torque blade driver. A motor shaft is arranged to rotate about a second rotational axis that is non-coaxial with the first rotational axis. A locking shifter is configured for axial translation along the second rotational axis. The locking shifter has a blocking tab portion configured for selective engagement with the perimetrical lock recess of the torque blade driver. A rotational-to-linear motion converter is drivably interposed between the motor shaft and the locking shifter and is configured such that a rotation of the motor shaft results in an axial displacement of the locking shifter to one of a locked position and an unlocked position.

18 Claims, 12 Drawing Sheets

(56) References Cited

U.S. PATENT DOCUMENTS

| | | | | |
|---|---|---|---|---|
| 3,733,863 | A | 5/1973 | Toepfer | |
| 4,073,527 | A | 2/1978 | Schlage | |
| 4,148,092 | A | 4/1979 | Martin | |
| 4,270,781 | A | 6/1981 | Nishimura | |
| 4,420,060 | A | 12/1983 | Kakimoto | |
| 4,438,962 | A | 3/1984 | Soloviff et al. | |
| 4,519,640 | A | 5/1985 | Mombelli | |
| 4,640,110 | A | 2/1987 | Fish et al. | |
| 4,656,850 | A | 4/1987 | Tabata | |
| 4,676,083 | A | 6/1987 | Sedley et al. | |
| 4,736,970 | A | 4/1988 | McGourty et al. | |
| 4,770,012 | A | 9/1988 | Johansson et al. | |
| 4,893,704 | A | 1/1990 | Fry et al. | |
| 5,040,652 | A | 8/1991 | Fish et al. | |
| 5,052,205 | A | 10/1991 | Poli | |
| 5,083,122 | A | 1/1992 | Clark | |
| 5,121,618 | A | 6/1992 | Scott | |
| 5,136,870 | A | 8/1992 | Gartner et al. | |
| 5,228,730 | A | 7/1993 | Gokcebay et al. | |
| 5,440,909 | A | 8/1995 | Ely et al. | |
| 5,473,922 | A | 12/1995 | Bair et al. | |
| 5,474,348 | A | 12/1995 | Palmer et al. | |
| 5,475,996 | A | 12/1995 | Chen | |
| 5,609,051 | A | 3/1997 | Donaldson | |
| 5,640,863 | A | 6/1997 | Frolov | |
| 5,709,114 | A | 1/1998 | Dawson et al. | |
| 5,712,626 | A | 1/1998 | Andreou et al. | |
| D390,446 | S | 2/1998 | Gartner | |
| 5,734,310 | A | 3/1998 | Ankney et al. | |
| 5,857,365 | A | 1/1999 | Armstrong | |
| 5,873,276 | A | 2/1999 | Dawson et al. | |
| 5,876,073 | A | 3/1999 | Geringer et al. | |
| 5,887,467 | A | 3/1999 | Butterweck et al. | |
| 5,894,277 | A | 4/1999 | Keskin et al. | |
| 5,933,067 | A | 8/1999 | Frolov | |
| 5,933,086 | A | 8/1999 | Tischendorf et al. | |
| 5,936,500 | A | 8/1999 | Martus et al. | |
| 6,016,677 | A | 1/2000 | Clark | |
| 6,062,612 | A | 5/2000 | Lin | |
| 6,098,433 | A | 8/2000 | Maniaci | |
| 6,107,934 | A | 8/2000 | Andreou et al. | |
| 6,125,673 | A | 10/2000 | Luker | |
| D438,447 | S | 3/2001 | Gartner | |
| 6,196,037 | B1 | 3/2001 | Urschel et al. | |
| 6,286,347 | B1 | 9/2001 | Frolov | |
| 6,297,725 | B1 | 10/2001 | Tischendorf et al. | |
| 6,298,699 | B1 | 10/2001 | Gartner et al. | |
| 6,318,137 | B1 | 11/2001 | Chaum | |
| 6,345,522 | B1 | 2/2002 | Stillwagon et al. | |
| 6,378,344 | B1 | 4/2002 | Gartner | |
| 6,442,983 | B1 | 9/2002 | Thomas et al. | |
| D464,862 | S | 10/2002 | Younani | |
| 6,512,435 | B2 | 1/2003 | van Namen | |
| 6,584,818 | B2 | 7/2003 | Bates et al. | |
| 6,598,909 | B2 | 7/2003 | Lu | |
| 6,615,629 | B2 | 9/2003 | Bates et al. | |
| 6,619,085 | B1 | 9/2003 | Hsieh | |
| 6,622,534 | B1 | 9/2003 | Miller et al. | |
| 6,655,180 | B2 | 12/2003 | Gokcebay et al. | |
| 6,718,808 | B2 | 4/2004 | Yu | |
| 6,865,916 | B2 | 3/2005 | Goldman | |
| 6,876,293 | B2 | 4/2005 | Frolov et al. | |
| 6,895,791 | B2 | 5/2005 | Alexander et al. | |
| 6,935,149 | B1 | 8/2005 | Peng et al. | |
| 7,007,526 | B2 * | 3/2006 | Frolov et al. | 70/277 |
| 7,051,561 | B2 | 5/2006 | Moon et al. | |
| D526,883 | S | 8/2006 | Gilbert | |
| 7,091,429 | B2 | 8/2006 | Case et al. | |
| 7,096,697 | B2 | 8/2006 | Keightly | |
| 7,096,698 | B2 | 8/2006 | Walsh, III et al. | |
| 7,168,276 | B2 | 1/2007 | Errani et al. | |
| D536,948 | S | 2/2007 | Fields | |
| D537,319 | S | 2/2007 | Fields | |
| 7,188,495 | B2 | 3/2007 | Errani et al. | |
| 7,231,791 | B2 | 6/2007 | Sakai | |
| 7,408,433 | B1 | 8/2008 | Irwin | |
| 7,424,814 | B2 | 9/2008 | Jasper | |
| 7,543,469 | B1 * | 6/2009 | Tseng et al. | 70/472 |
| 7,591,157 | B2 | 9/2009 | O'Neill et al. | |
| 7,698,919 | B2 | 4/2010 | Kim | |
| 7,827,837 | B2 | 11/2010 | Huang et al. | |
| 8,141,400 | B2 * | 3/2012 | Sorensen et al. | 70/279.1 |
| 8,176,761 | B2 * | 5/2012 | Sorensen et al. | 70/279.1 |
| 8,365,561 | B2 * | 2/2013 | Chang | 70/472 |
| 2001/0005998 | A1 * | 7/2001 | Imedio Ocana | 70/277 |
| 2002/0095962 | A1 | 7/2002 | Doerr et al. | |
| 2004/0040355 | A1 | 3/2004 | Goldman | |
| 2004/0055346 | A1 | 3/2004 | Gillert | |
| 2005/0050929 | A1 | 3/2005 | Meyerle | |
| 2005/0183480 | A1 | 8/2005 | Hingston et al. | |
| 2006/0065027 | A1 | 3/2006 | Valentine | |
| 2007/0051145 | A1 | 3/2007 | Chang | |
| 2007/0266747 | A1 | 11/2007 | Rafferty et al. | |
| 2007/0289346 | A1 | 12/2007 | Hyatt, Jr. | |
| 2008/0078220 | A1 | 4/2008 | Kim | |
| 2008/0121001 | A1 | 5/2008 | Huang et al. | |
| 2009/0084147 | A1 | 4/2009 | Mizutani et al. | |
| 2009/0133454 | A1 * | 5/2009 | Frolov et al. | 70/279.1 |
| 2009/0229326 | A1 | 9/2009 | Pukari et al. | |
| 2010/0064744 | A1 | 3/2010 | Miller et al. | |
| 2010/0236306 | A1 | 9/2010 | Trempala et al. | |
| 2010/0242555 | A1 * | 9/2010 | Frolov et al. | 70/431 |
| 2010/0253167 | A1 | 10/2010 | Charnley et al. | |
| 2010/0257906 | A1 * | 10/2010 | Sorensen et al. | 70/91 |
| 2010/0277264 | A1 | 11/2010 | Charnley et al. | |
| 2010/0294008 | A1 * | 11/2010 | Bogdanov et al. | 70/277 |

FOREIGN PATENT DOCUMENTS

| | | | |
|---|---|---|---|
| CN | 201280846 | Y | 7/2009 |
| DE | 202004016988 | U1 | 3/2006 |
| EP | 0877133 | A2 | 11/1998 |
| FR | 2653480 | A1 | 4/1991 |
| GB | 2366595 | A | 3/2002 |
| GB | 2413596 | A | 11/2005 |
| GB | 2427647 | A | 1/2007 |
| GB | 2429748 | A | 3/2007 |
| JP | 2009030426 | A | 2/2009 |
| WO | 9715739 | A2 | 5/1997 |
| WO | 2007000576 | A1 | 1/2007 |

* cited by examiner

MANUALLY DRIVEN ELECTRONIC DEADBOLT ASSEMBLY WITH FIXED TURNPIECE

CROSS-REFERENCE TO RELATED APPLICATIONS

This is a non-provisional application based upon U.S. provisional patent application Ser. No. 61/514,192, filed Aug. 2, 2011.

BACKGROUND OF THE INVENTION

1. Field of the Invention

The present invention relates to door lock devices, and more particularly, to a manually driven electronic deadbolt assembly with a fixed turnpiece, such that but for a ratcheting effect provided by a clutch assembly, an exterior turnpiece is rotatably fixed to a torque blade that in turn is rotatably fixed to a deadbolt mechanism.

2. Description of the Related Art

A keyed deadbolt assembly is used to supplement the level of security provided by a simple keyed lock configured integral with a doorknob. A traditional deadbolt assembly includes an exterior keyed lock cylinder and a cylinder body that projects away from the surface of a standard door. The lock cylinder has a tail piece that is operably connected to a deadbolt actuation mechanism to facilitate retraction and extension of the deadbolt. An interior turnpiece is provided on the interior side of the door, and also is operably connected to the deadbolt actuation mechanism.

Some attempts have been made to provide an electronic door latch, which may utilize motorized retraction of the latch bolt. Also, such electronic door latches may require door modification to accommodate the electronic door latch.

SUMMARY OF THE INVENTION

The present invention provides a manually driven electronic deadbolt assembly with a fixed turnpiece, such that but for a ratcheting effect provided by a clutch assembly, the exterior turnpiece is rotatably fixed to a torque blade that in turn is rotatably fixed to a deadbolt mechanism.

The invention, in one form thereof, is directed to an exterior actuator assembly for a manually driven electronic deadbolt assembly and configured to operate a deadbolt mechanism from an exterior space via a torque blade. The exterior actuator assembly has a locked condition and an unlocked condition. The exterior actuator assembly includes an exterior turnpiece rotatably mounted to a cylinder body. A torque blade driver is coupled to the torque blade. The torque blade driver has a perimetrical lock recess. The torque blade driver is rotatable about a first rotational axis. A clutch assembly is drivably interposed between the exterior turnpiece and the torque blade driver. A motor has a motor shaft arranged to rotate about a second rotational axis that is non-coaxial with the first rotational axis. A locking shifter is mounted to the cylinder body and is configured for axial translation along the second rotational axis. The locking shifter has a blocking tab portion configured for selective engagement with the perimetrical lock recess of the torque blade driver. A rotational-to-linear motion converter is drivably interposed between the motor shaft and the locking shifter and is configured such that a rotation of the motor shaft in a first rotational direction about the second rotational axis results in an axial displacement of the locking shifter in a first longitudinal direction to a locked position corresponding to the locked condition wherein the blocking tab portion of the locking shifter is engaged with the perimetrical lock recess of the torque blade driver to prohibit rotation of the torque blade via the exterior turnpiece, and a rotation of the motor shaft in a second rotational direction about the second rotational axis results in an axial displacement of the locking shifter in a second longitudinal direction to an unlocked position corresponding to the unlocked condition wherein the blocking tab portion of the locking shifter is disengaged from the perimetrical lock recess of the torque blade driver to permit rotation of the torque blade via the exterior turnpiece.

The invention, in another form thereof, is directed to a manually driven electronic deadbolt assembly for use on a door separating an exterior space from a secured space. The manually driven electronic deadbolt assembly includes an interior actuator assembly, an exterior actuator assembly, a deadbolt mechanism, and a torque blade. The deadbolt mechanism has a spindle drive opening. The torque blade is configured to be drivably received in the spindle drive opening of the deadbolt mechanism. The torque blade has a first end, a second end, and a first rotational axis. The interior actuator assembly is configured to operate the deadbolt mechanism from the secured space. The interior actuator is mechanically connected to the first end of the torque blade. An exterior actuator assembly is configured to operate the deadbolt mechanism from the exterior space. The exterior actuator assembly has a locked condition and an unlocked condition. The exterior actuator assembly includes a cylinder body, and an exterior turnpiece rotatably mounted to the cylinder body. A torque blade driver is coupled to the second end of the torque blade, with the torque blade driver having a perimetrical lock recess. A clutch mechanism is drivably interposed between the exterior turnpiece and the torque blade driver. A motor has a motor shaft arranged to rotate about a second rotational axis that is non-coaxial with the first rotational axis. A locking shifter is mounted to the cylinder body and is configured for axial translation along the second rotational axis. The locking shifter has a blocking tab portion configured for selective engagement with the perimetrical lock recess of the torque blade driver. A rotational-to-linear motion converter is drivably interposed between the motor shaft and the locking shifter and is configured such that a rotation of the motor shaft in a first rotational direction about the second rotational axis results in an axial displacement of the locking shifter in a first longitudinal direction to a locked position corresponding to the locked condition wherein the blocking tab portion of the locking shifter is engaged with the perimetrical lock recess of the torque blade driver to prohibit rotation of the torque blade via the exterior turnpiece. A rotation of the motor shaft in a second rotational direction about the second rotational axis results in an axial displacement of the locking shifter in a second longitudinal direction to an unlocked position corresponding to the unlocked condition wherein the blocking tab portion of the locking shifter is disengaged from the perimetrical lock recess of the torque blade driver to permit rotation of the torque blade via the exterior turnpiece.

The invention, in another form thereof, is directed to a method for operating a deadbolt mechanism mounted on a door that separates an exterior space from a secured space, the deadbolt mechanism having a spindle drive opening, the method including: providing a torque blade configured to be drivably received in the spindle drive opening of the deadbolt mechanism, the torque blade having a first end, a second end, and a first rotational axis; providing an interior actuator assembly for operating the deadbolt mechanism from the secured space, the interior actuator being mechanically connected to the first end of the torque blade; and providing an exterior actuator assembly for operating the deadbolt mechanism from the exterior space, the exterior actuator assembly having a locked condition and an unlocked condition, the exterior actuator assembly including: a cylinder body; an exterior turnpiece rotatably mounted to the cylinder body; a torque blade driver coupled to the second end of the torque blade, the torque blade driver having a perimetrical lock recess; a clutch mechanism drivably interposed between the exterior turnpiece and the torque blade driver; a motor having a motor shaft arranged to rotate about a second rotational axis that is non-coaxial with the first rotational axis; a locking shifter mounted to the cylinder body and configured for axial translation along the second rotational axis, the locking shifter having a blocking tab portion configured for selective engagement with the perimetrical lock recess of the torque blade driver; and a rotational-to-linear motion converter drivably interposed between the motor shaft and the locking shifter and configured such that a rotation of the motor shaft in a first rotational direction about the second rotational axis results in an axial displacement of the locking shifter in a first longitudinal direction to a locked position corresponding to the locked condition wherein the blocking tab portion of the locking shifter is engaged with the perimetrical lock recess of the torque blade driver to prohibit rotation of the torque blade via the exterior turnpiece, and a rotation of the motor shaft in a second rotational direction about the second rotational axis results in an axial displacement of the locking shifter in a second longitudinal direction to an unlocked position corresponding to the unlocked condition wherein the blocking tab portion of the locking shifter is disengaged from the perimetrical lock recess of the torque blade driver to permit rotation of the torque blade via the exterior turnpiece.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, in one form, and such exemplifications are not to be construed as limiting the scope of the invention in any manner.

DETAILED DESCRIPTION OF THE INVENTION

Figure 1:
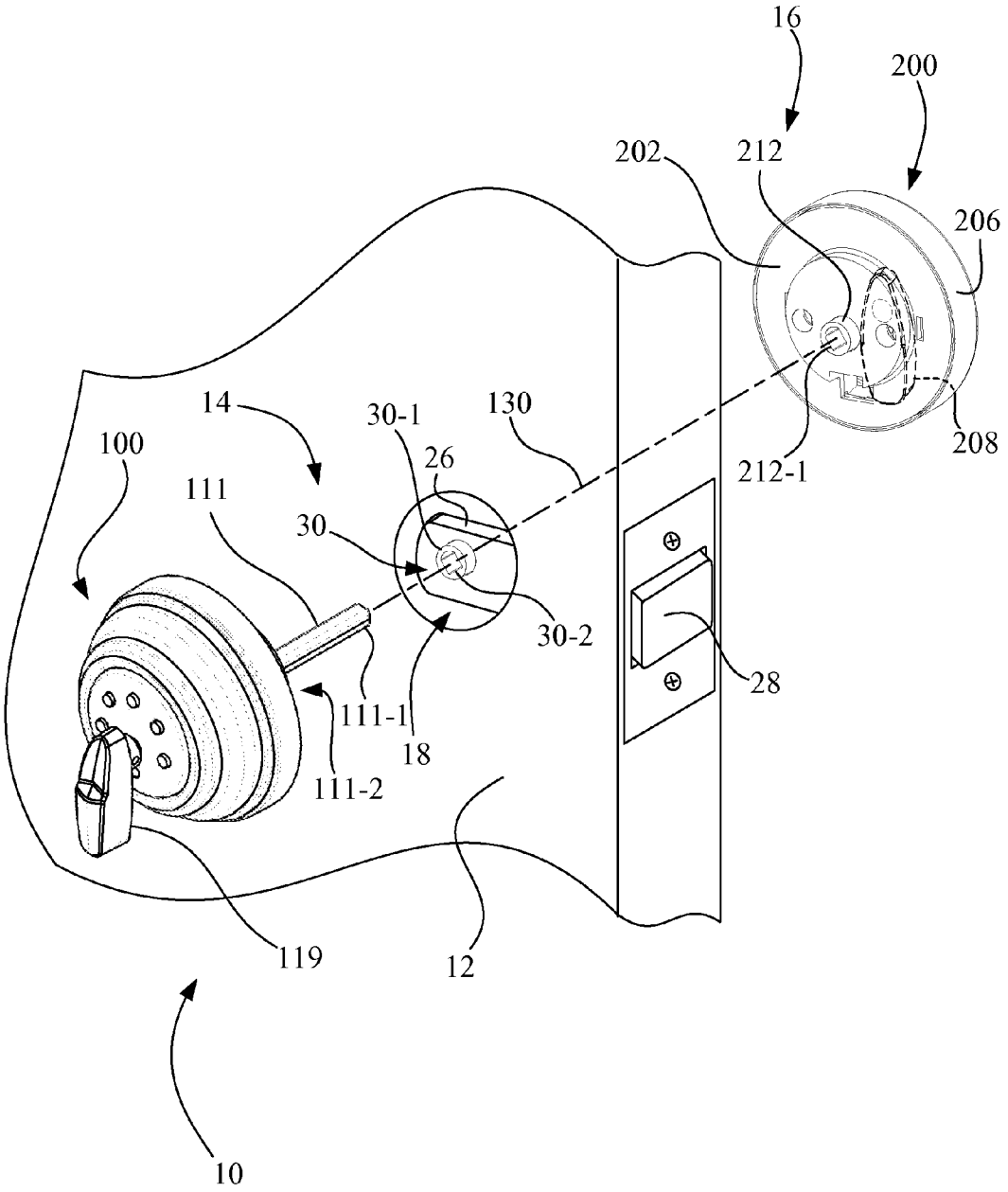
FIG. 1 is an exploded view of a manually driven electronic deadbolt assembly in accordance with the embodiments of the present invention for use on a door that separates an exterior space from a secured space.

Referring now to the drawings, and more particularly to FIG. 1, there is shown a manually driven electronic deadbolt assembly 10 in accordance with an embodiment of the present invention for use on a door 12 separating an exterior space 14 from a secured (interior) space 16. Manually driven electronic deadbolt assembly 10 includes a deadbolt mechanism 18, an exterior actuator assembly 100, a torque blade 111 and interior actuator assembly 200. The term "deadbolt" as used herein is intended to include both the traditional deadbolt having a substantially blunt distal end, as well as the structure commonly referred to as a "latch bolt" having a beveled or rounded distal end.

Deadbolt mechanism 18 includes a housing 26 that carries a retractable deadbolt 28, and is configured as is well known in the art. Deadbolt mechanism 18 includes a deadbolt drive mechanism 30 having a spindle drive 30-1 that has a spindle drive opening 30-2. Spindle drive opening 30-2 is non-circular, e.g., having a square or D-shaped cross-section, so as to receive a rotational driving force from torque blade 111 having a similarly shaped profile.

Torque blade 111 extends between interior actuator assembly 200 and exterior actuator assembly 100, and is slidably received through spindle drive opening 30-2 of deadbolt drive mechanism 30. Torque blade 111 has a first end 111-1 that is received by a portion of interior actuator assembly 200 and has a second end 111-2 that is received by a portion of exterior actuator assembly 100.

Torque blade 111 is configured to drive deadbolt drive mechanism 30 of deadbolt mechanism 18 by a rotation of torque blade 111 about first rotational axis 130. Thus, torque blade 111 is configured to be drivably received in spindle drive opening 30-2 of deadbolt mechanism 18, and in this regard torque blade 111 has a cross-section shape, e.g., square or D-shaped, that corresponds to the shape of spindle drive opening 30-2 so as to convey a rotational force to deadbolt drive mechanism 30 of deadbolt mechanism 18.

Figure 2:
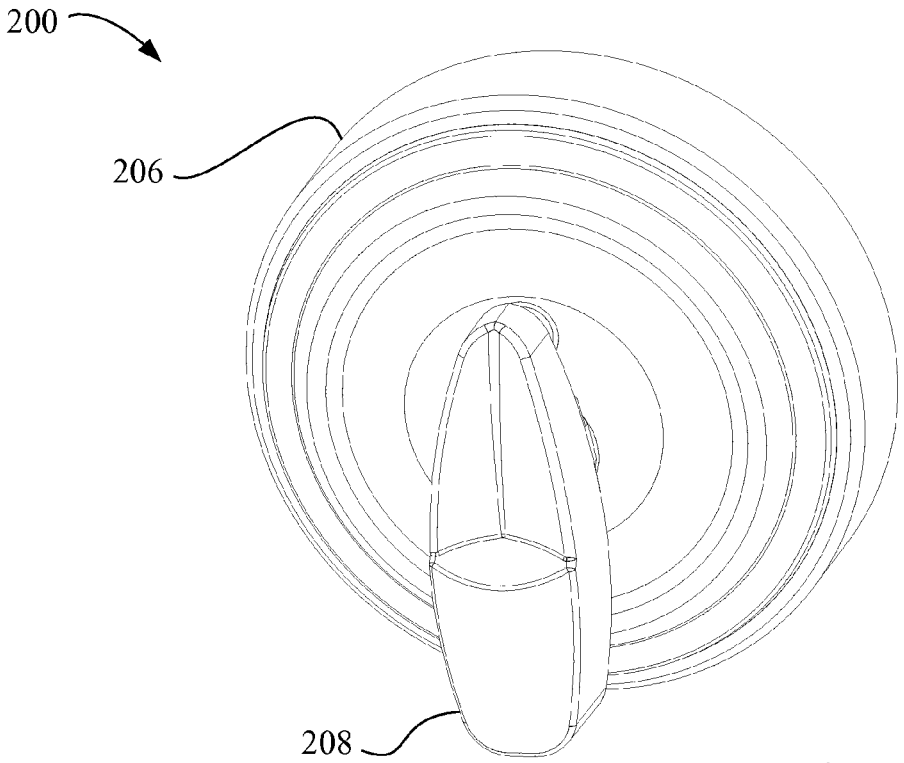
FIG. 2 is a front perspective view of an interior actuator assembly of the manually driven electronic deadbolt assembly of FIG. 1.
Figure 3:
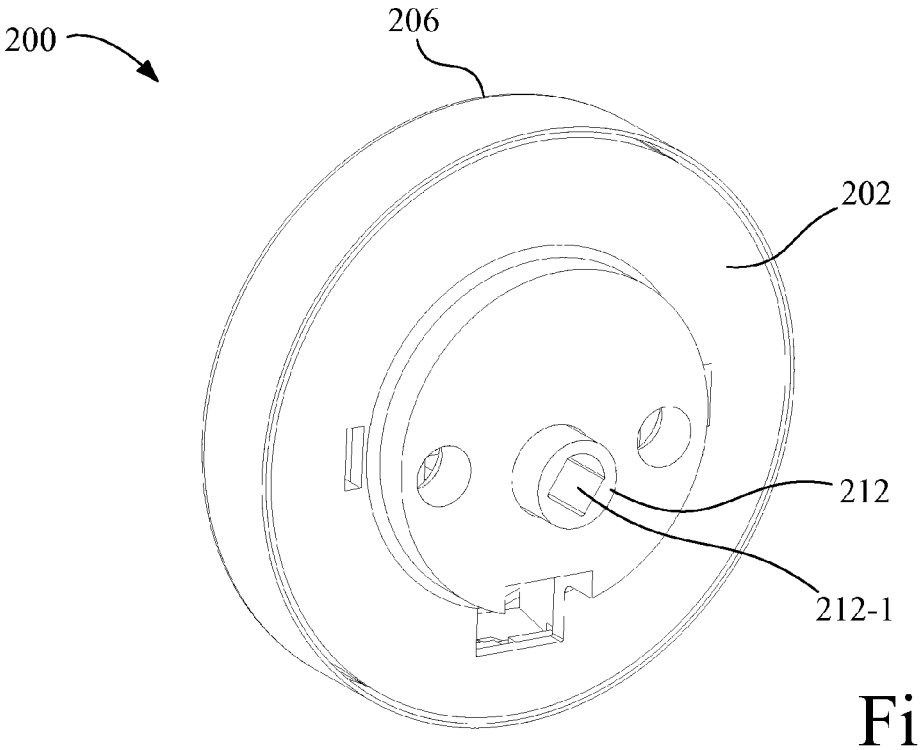
FIG. 3 is a rear perspective view of the interior actuator assembly of the manually driven electronic deadbolt assembly of FIG. 1.
Figure 4:
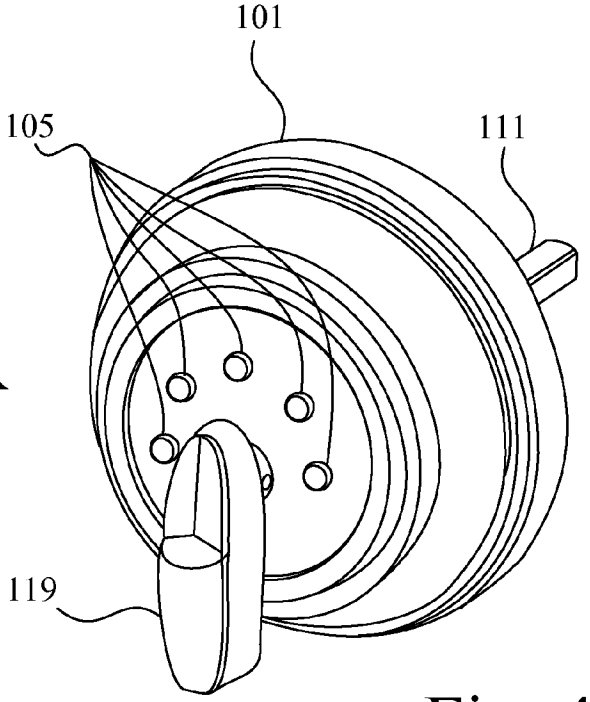
FIG. 4 is a front perspective view of an exterior actuator assembly of the manually driven electronic deadbolt assembly of FIG. 1.
Figure 5:
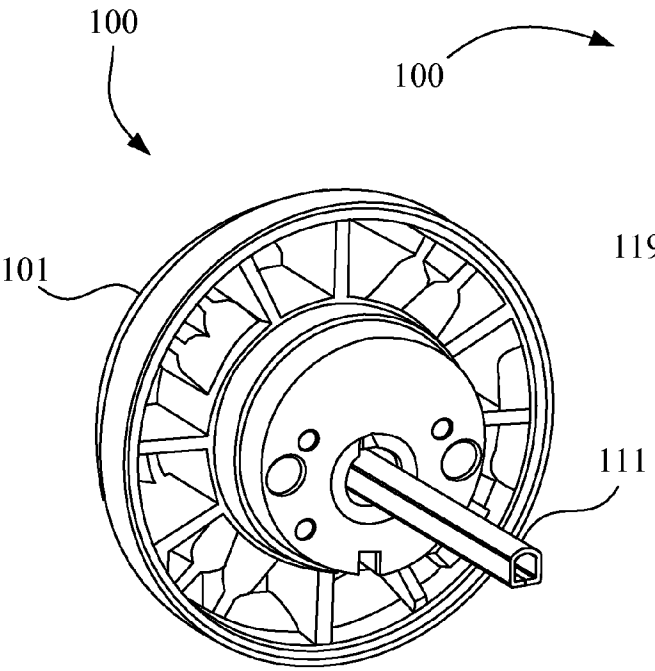
FIG. 5 is a rear perspective view of an exterior actuator assembly of the manually driven electronic deadbolt assembly of FIG. 1.
Figure 6:
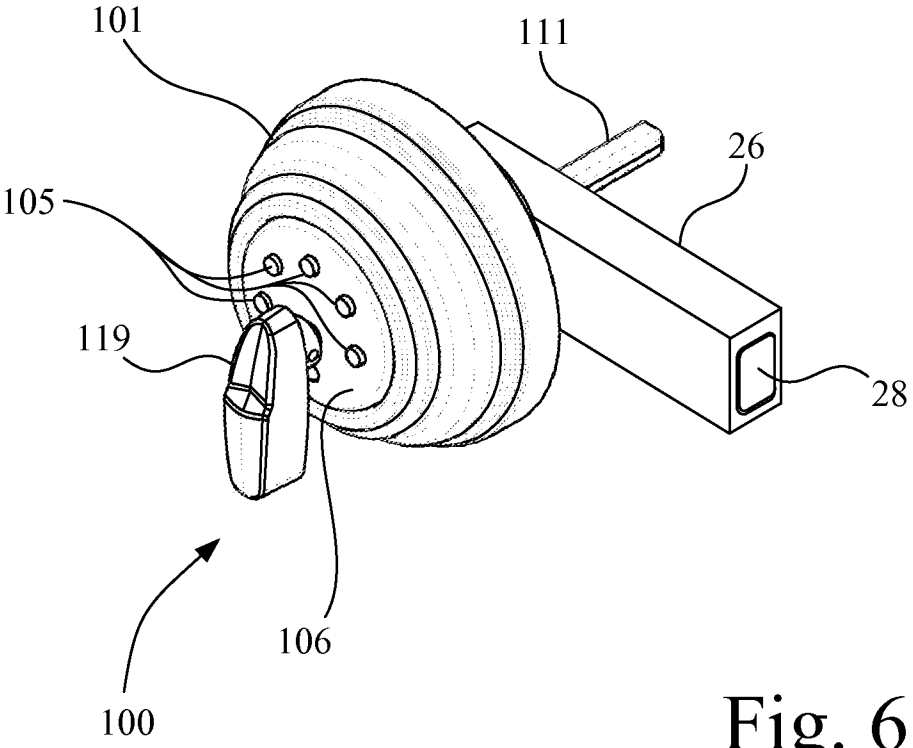
FIG. 6 is a perspective view of the exterior actuator assembly of FIGS. 4 and 5 drivably coupled to a standard deadbolt/latch bolt mechanism.

Referring also to FIGS. 2 and 3, interior actuator assembly 200 includes a base 202; an interior cover 206, which may be also referred to as interior rose 206; and an interior torque blade driver 212 that has a shaped opening 212-1 for drivably receiving first end 111-1 of torque blade 111. Base 202 is configured to mount interior actuator assembly 200 to door 12. Cover 206 has an opening for mounting interior turnpiece 208, and as such interior turnpiece 208 is rotatably mounted to interior cover 206. Interior torque blade driver 212 is drivably attached to interior turnpiece 208.

Interior actuator assembly 200 is configured to operate deadbolt mechanism 18 from the secured space 16 via interior turnpiece 208. More particularly, interior actuator assembly 200 is configured in a fail-safe manner to provide a continuous drive via interior turnpiece 208 through torque blade 111 to selectively retract and extend retractable deadbolt 28 of deadbolt mechanism 18 by a rotation of interior turnpiece 208. In other words, interior turnpiece 208 is always drivably connected to deadbolt mechanism 18 to operate retractable deadbolt 28.

Referring to FIGS. 1 and 4-8, the exterior actuator assembly 100 includes a cylinder guard cover 101, a cylinder body 102, a printed circuit board box 103, a printed circuit board 104, a keypad 105, a keypad cap 106, a locking shifter 107, a motor 108, a torque blade driver 109, a collar 110, a torque blade 111, a retainer clip 112, a pin follower 113, a motor spring 114, a torsion spring 115, a turnpiece clutch shaft 116, a clutch spring 117, a turnpiece clutch driver 118, an exterior turnpiece 119, a retaining ring 120, and a turnpiece spring 121.

In general, cylinder body 102 is a non-rotatable chassis that is used to mount exterior actuator assembly 100 to an exterior of door 12. Turnpiece 119 is rotatably mounted to cylinder body 102, and is rotatably coupled to torque blade 111 for operation of deadbolt mechanism 18 via a clutch assembly 124 and the torque blade driver 109. Thus, but for a ratcheting effect provided by clutch assembly 124, turnpiece 119 is rotatably fixed to torque blade 111, and in turn is rotatably fixed to deadbolt mechanism 18. The locking of the manually driven electronic deadbolt lock unit to prevent actuation of deadbolt mechanism 18 by the exterior actuator assembly 100 is effected by an off-axis blocking of the rotation of the torque blade driver 109, as described in more detail below.

Clutch assembly 124 includes turnpiece clutch shaft 116, clutch spring 117, turnpiece clutch driver 118 and retaining ring 120. Turnpiece clutch shaft 116 includes a proximal end 116-1 and a distal end 116-2. Intermediate of the proximal end 116-1 and the distal end 116-2 is an annular groove 116-3. Spaced toward distal end 116-2 from the annular groove 116-3 is a pair of opposed V-shaped ramps 116-4, 116-5.

Figure 7:
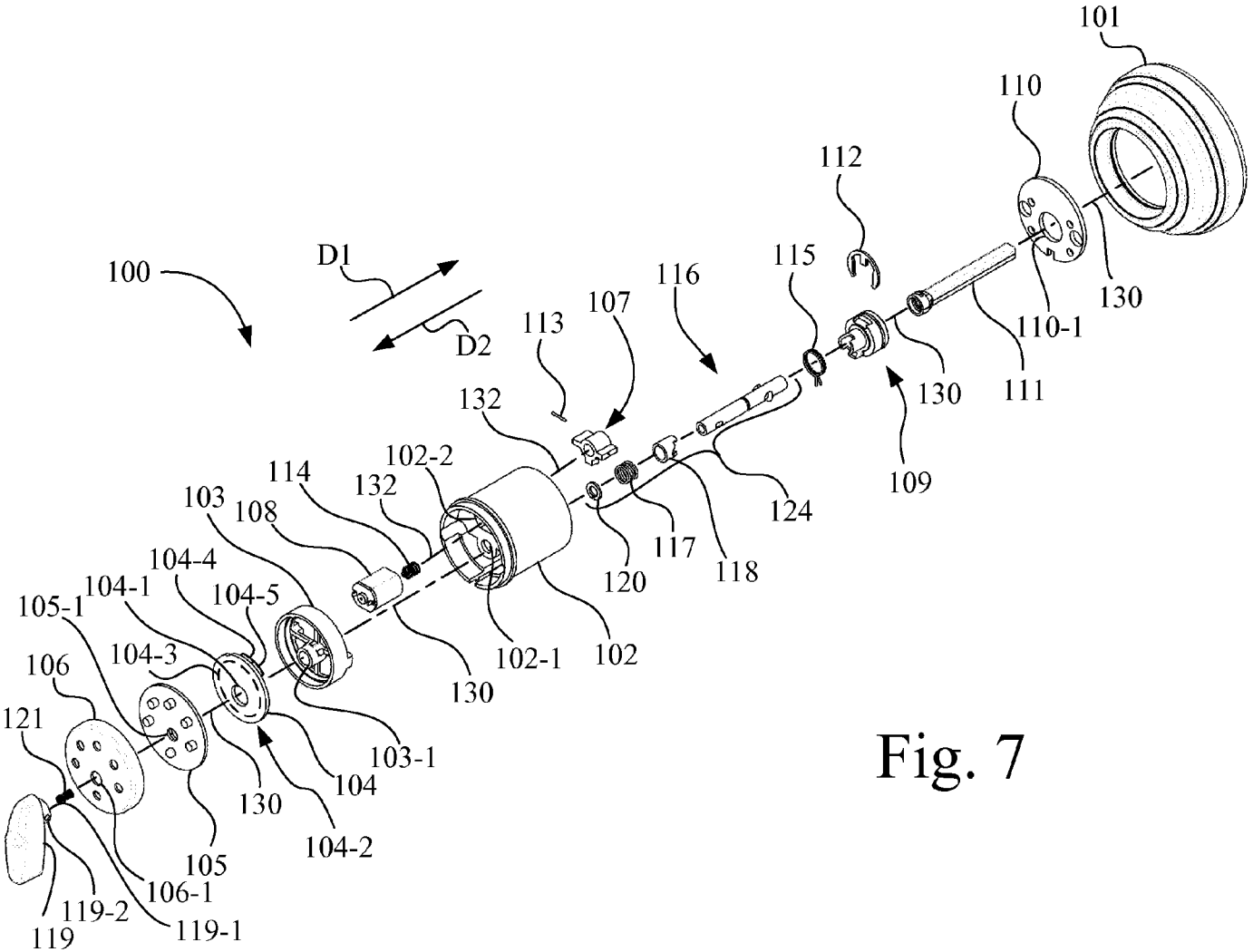
FIG. 7 is an exploded view of the exterior actuator assembly of FIGS. 4-6.

Referring to FIG. 7, cylinder body 102 includes an opening 102-1 defining a first rotational axis 130 for torque blade 111, with the opening 102-1 being configured as a first axial bore 102-1 for receiving turnpiece clutch shaft 116 for rotation about the first rotational axis 130. Each of printed circuit board box 103, printed circuit board 104, keypad 105, and keypad cap 106 also include a respective opening 103-1, 104-1, 105-1, 106-1 for receiving turnpiece clutch shaft 116. The respective openings 102-1 and 103-1 in cylinder body 102 and printed circuit board box 103 provide radial bearing support for turnpiece clutch shaft 116.

Figure 8:
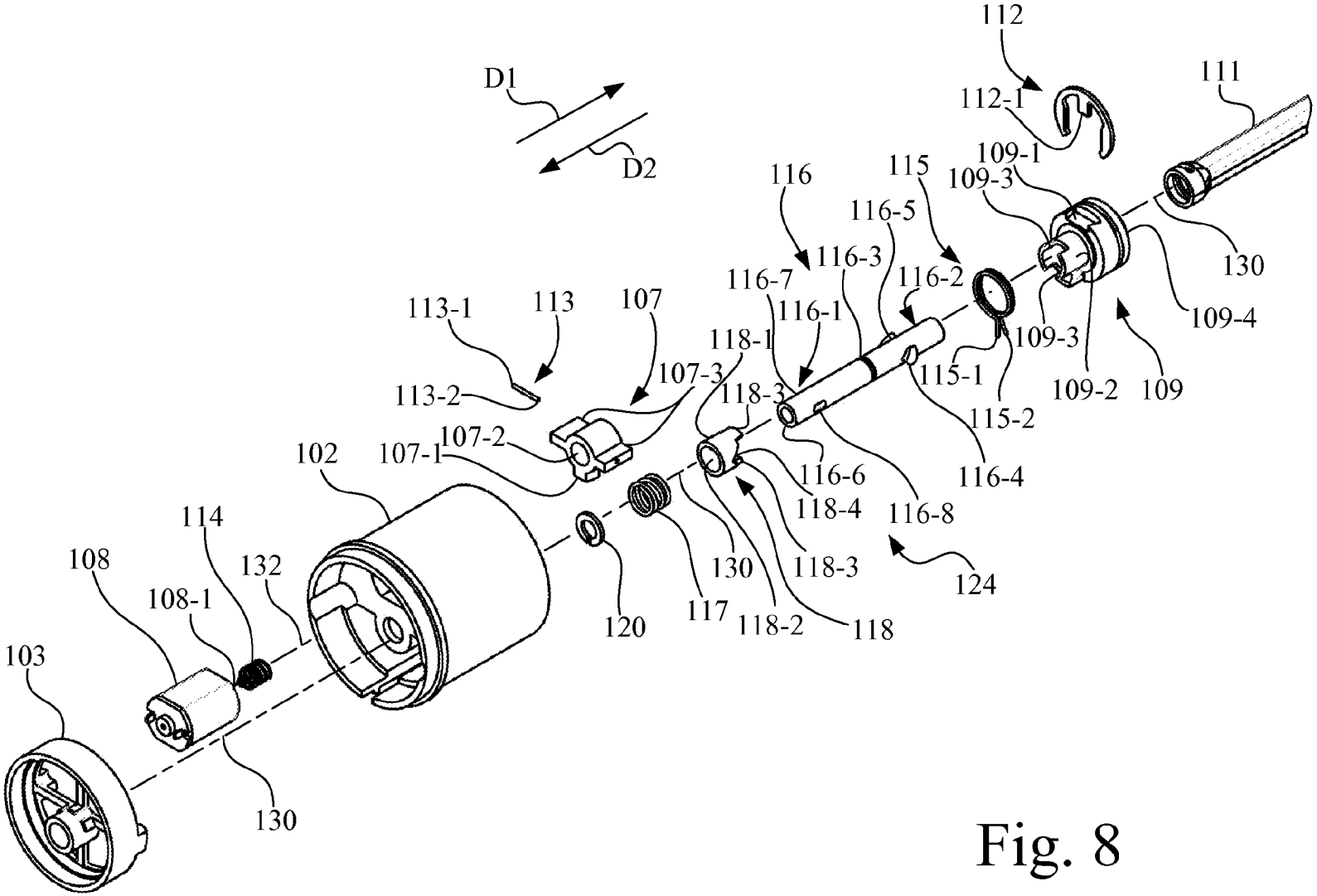
FIG. 8 is an enlarged portion of the exterior actuator assembly exploded view of FIG. 7.

Referring also to FIG. 8, turnpiece clutch driver 118 includes a body 118-1 having a bore 118-2, at least one (a pair shown) circumferential tab 118-3, and a pair of opposed V-shaped slots 118-4, 118-5. The one or more circumferential tabs 118-3 may be positioned at an approximately 90 degree offset from the pair of opposed V-shaped slots 118-4, 118-5. The one or more circumferential tabs 118-3 is/are configured to drivably engage the torque blade driver 109.

Figure 12:
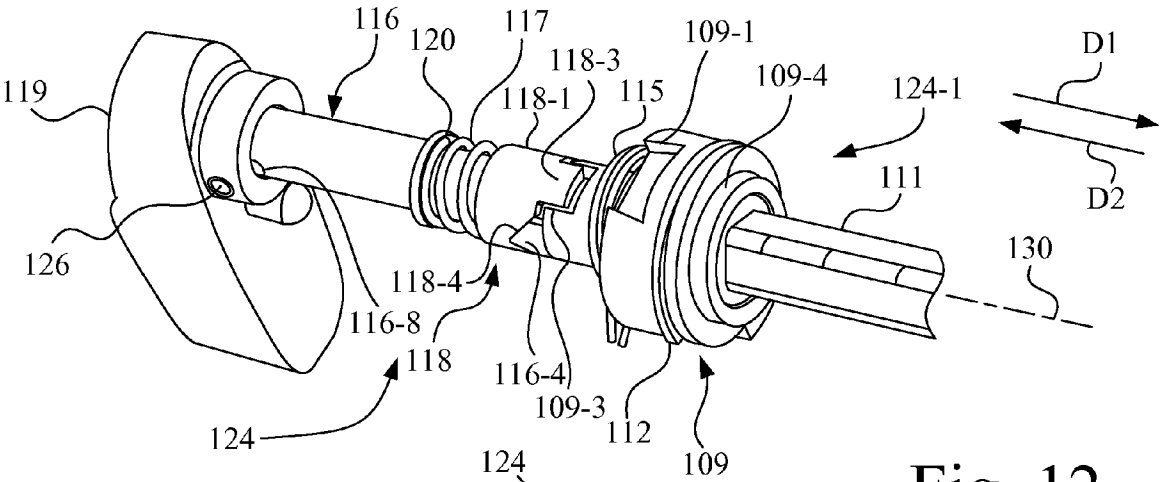
FIG. 12 is a perspective view of the exterior actuator assembly as shown in FIG. 9, with the cylinder body removed to expose the clutch assembly, with the turnpiece clutch driver drivably engaged with the torque blade driver.
Figure 13:
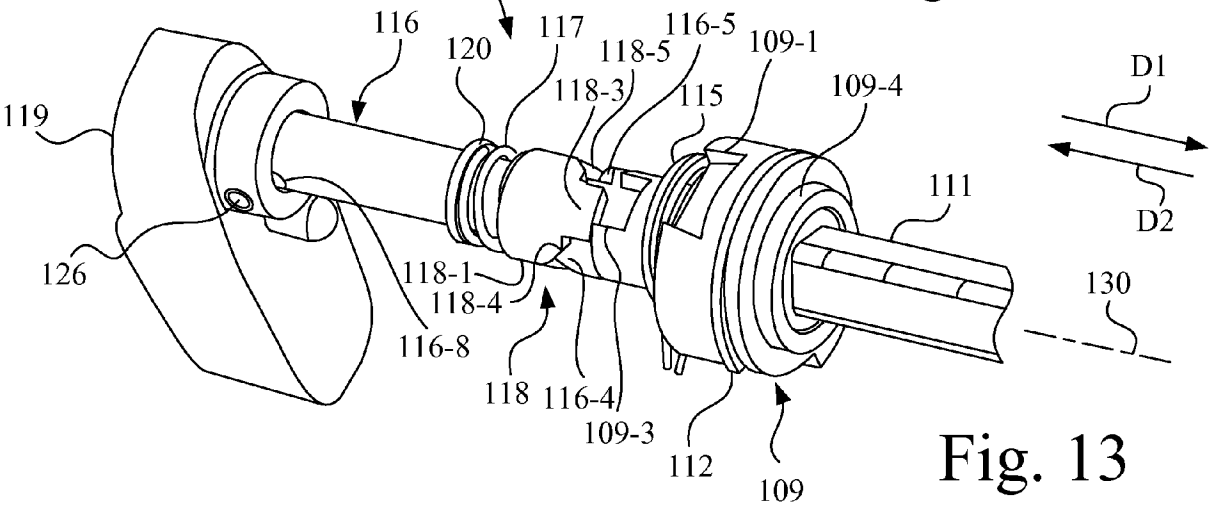
FIG. 13 is a perspective view of the exterior actuator assembly as shown in FIG. 9, with the cylinder body removed to expose the clutch assembly, with the turnpiece clutch driver drivably disengaged from the torque blade driver.

Referring also to FIGS. 12 and 13, clutch assembly 124 is assembled as follows. The proximal end 116-1 of turnpiece clutch shaft 116 is inserted into the bore 118-2 of turnpiece clutch driver 118. Clutch spring 117 is then slipped over the proximal end 116-1 of turnpiece clutch shaft 116 and into engagement with the turnpiece clutch driver 118. Clutch spring 117 is then compressed toward distal end 116-2 of turnpiece clutch shaft 116 to force turnpiece clutch driver 118 in a direction D1 toward the distal end 116-2, such that the pair of opposed V-shaped slots 118-4, 118-5 of turnpiece clutch driver 118 engage the pair of opposed V-shaped ramps 116-4, 116-5 of the turnpiece clutch shaft 116. The retaining ring 120 is then installed into the intermediate annular groove 116-3 of turnpiece clutch shaft 116 to hold clutch spring 117 in a state of compression, and thus biasing turnpiece clutch driver 118 in the direction D1 toward the distal end 116-2 of turnpiece clutch shaft 116 such that the pair of opposed V-shaped slots 118-4, 118-5 of turnpiece clutch driver 118 are nested in engagement with the pair of opposed V-shaped ramps 116-4, 116-5 of the turnpiece clutch shaft 116, thus defining a home position 124-1 of clutch assembly 124.

Figure 9:
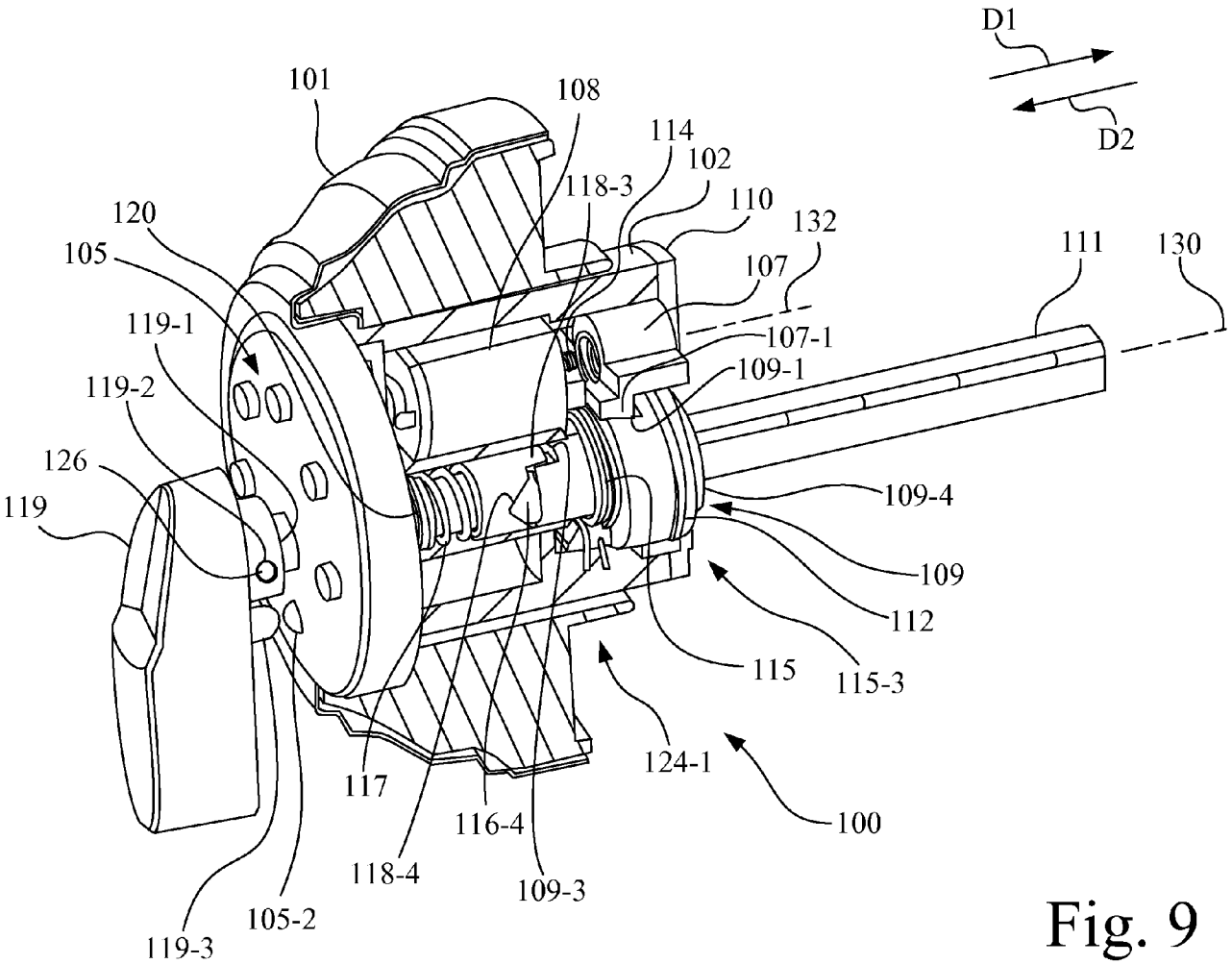
FIG. 9 is a partial section view of the exterior actuator assembly of FIGS. 4-8, with the locking shifter extended to the locked position.
Figure 10:
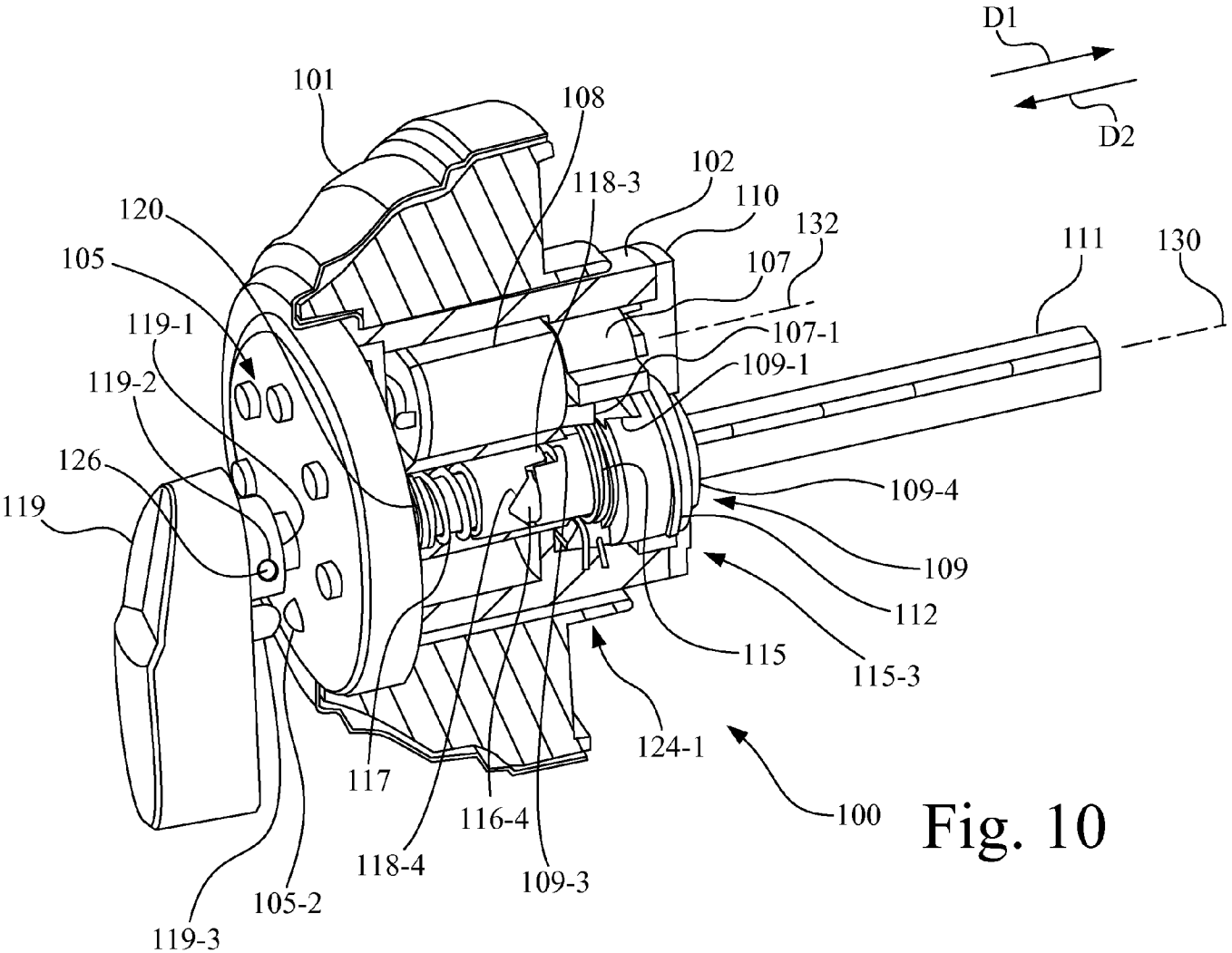
FIG. 10 is a partial section view of the exterior actuator assembly of FIGS. 4-8, with the locking shifter retracted to the unlocked position.

Referring also to FIGS. 9 and 10, in clutch assembly 124 described above, a relative rotation between turnpiece clutch driver 118 and turnpiece clutch shaft 116 will cause the pair of opposed V-shaped slots 118-4, 118-5 of the turnpiece clutch driver 118 to ride up the pair of opposed V-shaped ramps 116-4, 116-5 of the turnpiece clutch shaft 116, thereby causing a proximal axial movement of turnpiece clutch driver 118 in direction D2 toward the proximal end 116-1 of turnpiece clutch shaft 116, thereby further compressing the clutch spring 117. This proximal axial movement of the turnpiece clutch driver 118 in direction D2 causes the circumferential tab(s) 118-3 of the turnpiece clutch driver 118 to disengage from the torque blade driver 109, thus preventing damage to exterior actuator assembly 100 if the turnpiece 119 is forcibly rotated when the torque blade driver 109 is blocked from rotation (e.g., locked), or if the turnpiece 119 is forcibly rotated beyond the rotational limits of the torque blade driver 109, e.g., beyond 90 degrees of rotation.

The proximal end 116-1 of turnpiece clutch shaft 116 includes an end bore 116-6 defining a sidewall 116-7 in which there is formed a pair of diametrically opposed axially extending slots 116-8. The turnpiece spring 121 is inserted into the end bore 116-6, and a bore 119-1 in turnpiece 119 is fitted over the proximal end 116-1 of the turnpiece clutch shaft 116. A turnpiece connecting pin 126 is then inserted radially through a radial hole 119-2 in the turnpiece 119 and into and through the pair of diametrically opposed axially extending slots 116-8 on the sidewall 116-7 of the turnpiece clutch shaft 116 so as to mount the turnpiece 119 to turnpiece clutch shaft 116. The turnpiece spring 121 thus is interposed in a state of compression between the floor of the end bore 116-6 in the turnpiece clutch shaft 116 and the turnpiece 119, so as to bias the turnpiece 119 axially outwardly in direction D2.

Torque blade driver 109 is configured for driving engagement with torque blade 111, and torque blade 111 is configured, e.g., with a profiled perimeter (square, D-shaped, etc.) for driving engagement with the deadbolt mechanism 18. Torque blade driver 109 is further configured with a perimetrical, e.g., circumferential, lock recess 109-1 for selectively receiving a blocking tab portion 107-1 of locking shifter 107. Torque blade driver 109 is axially and rotatably mounted to torque blade 111, with torque blade driver 109 and torque blade 111 being held in driving engagement by an inwardly facing tab 112-1 of retainer clip 112. Torque blade driver 109 further includes an inner hub 109-2 having one or more circumferential slot(s) 109-3 for respectively receiving a corresponding circumferential tab 118-3 of turnpiece clutch driver 118.

Collar 110 includes a bore 110-1 serving as a bearing support for an outer annular surface 109-4 of torque blade driver 109, and with torque blade driver 109 being axially restrained in the distal direction D1 by collar 110. The collar 110 is mounted to cylinder body 102 via fasteners, e.g., screws, to close the interior side of cylinder body 102.

Torsion spring 115 has two protruding ends 115-1, 115-2 that are arranged to respectively engage a portion of torque blade driver 109 and a portion of cylinder body 102, so as to rotationally bias the torque blade driver to its home position 115-3 (see FIGS. 9 and 10). Torque blade driver 109 is in home position 115-3 when the circumferential lock recess 109-1 of torque blade driver 109 is in the correct rotational position, e.g., at a 12:00 o'clock position, to facilitate a locking operation.

Cylinder body 102 includes a second axial opening 102-2 for mounting motor 108. Motor 108 has a motor shaft 108-1 that is drivably coupled to motor spring (coil spring) 114, with motor shaft 108-1 and motor spring 114 being arranged to rotate about a second rotational axis 132. Second rotational axis 132 is arranged to be parallel to, and thus non-coaxial with, first rotational axis 130. Locking shifter 107 has an axial opening 107-2 positioned axially relative to second rotational axis 132. The axial opening 107-2 of locking shifter 107 is sized to loosely accommodate the circumferential perimeter of motor spring 114, such that motor spring 114 is moveable within the axial opening 107-2. Locking shifter 107 includes the blocking tab portion 107-1, which is configured to selectively engage the circumferential lock recess 109-1 of torque blade driver 109.

A proximal portion 113-1 of the pin follower 113 is radially received into a hole in an annular portion of locking shifter 107. A distal portion 113-2 of the pin follower 113 radially projects inwardly toward second rotational axis 132 from the annular portion of locking shifter 107, with the distal portion 113-2 of pin follower 113 being received between adjacent coils of motor spring 114 to form a rotational-to-linear motion converter. Locking shifter 107 includes one or more winged protrusions 107-3 configured to engage a corresponding slot or ledge in cylinder body 102 to prevent rotation of locking shifter 107 about second rotational axis 132 relative to motor spring 114 when motor spring 114 is rotated by motor 108 about second rotational axis 132.

With the distal portion 113-2 of pin follower 113 drivably received between the coils of motor spring 114, rotation of motor spring 114 by motor shaft 108-1 of motor 108 in a first rotational direction about rotational axis 132 results in an axial displacement of locking shifter 107 in a first longitudinal direction, e.g., in direction D1, to a locked position (see FIG. 9), and rotation of motor spring 114 by motor shaft 108-1 of motor 108 in a second rotational direction opposite the first rotational direction results in an axial displacement of locking shifter 107 in a second longitudinal direction, e.g., in direction D2, to an unlocked position (see FIG. 10), opposite the first longitudinal direction, thus forming a linear actuator for axially moving locking shifter 107 along the second rotational axis 132. As such, the blocking tab portion 107-1 of locking shifter 107 may be selectively engaged with or disengaged from the circumferential lock recess 109-1 of torque blade driver 109 to respectively lock and unlock exterior actuator assembly 100 and deadbolt mechanism 18.

When the blocking tab portion 107-1 of locking shifter 107 is engaged with circumferential lock recess 109-1 of torque blade driver 109, the manually driven electronic deadbolt lock unit is in the locked condition as illustrated in FIG. 9 and the actuation of deadbolt mechanism 18 by rotation of turnpiece 119 of the exterior actuator assembly 100 is prohibited.

Conversely, when blocking tab portion 107-1 of locking shifter 107 is disengaged from circumferential lock recess 109-1 of torque blade driver 109, the manually driven electronic deadbolt lock unit is in the unlocked condition, as illustrated in FIG. 10, and the actuation of deadbolt mechanism 18 by rotation of turnpiece 119 of the exterior actuator assembly 100 is enabled, i.e., permitted.

Referring again to FIG. 7, the printed circuit board 104 is electrically connected to motor 108. Printed circuit board 104 includes a control circuit 104-2 having memory, control logic, and a code input mechanism 104-3 having electrical actuators that correspond to the various buttons of keypad 105 (see also FIGS. 4-6). Control circuit 104-2 may be configured, for example, as a programmable microprocessor unit 104-4 having associated semiconductor memory 104-5 and input/output components (e.g., code input mechanism 104-3). Programmable microprocessor unit (control logic) 104-4 is coupled in electrical communication with the code input mechanism 104-3, and code input mechanism 104-3 receives key inputs from keypad 105. Control circuit 104-2 is configured with the control logic (hardwired or programmed) to discriminate between a valid input code and an invalid input code entered by a user via keypad 105. Such discrimination may be performed, for example, by comparison logic in control circuit 104-2 that compares the current input code entered by a user via keypad 105 to a set of valid input codes that may be stored in a lookup table in electronic memory (RAM, ROM EPROM, EEPROM, etc) 104-5 of control circuit 104-2.

In operation, a user will enter a pre-programmed access code via keypad 105, which in turn is converted into a command to shift locking shifter 107 in direction D2 to an unlocked position (see FIGS. 9 and 10) by actuation of motor 108 to place the exterior actuator assembly 100, and in turn the manually driven electronic deadbolt assembly 10, in the unlocked condition, as illustrated in FIG. 10, such that torque blade 111 is rotatable to operate the deadbolt 28 of deadbolt mechanism 18 (see FIG. 1).

Figure 11:
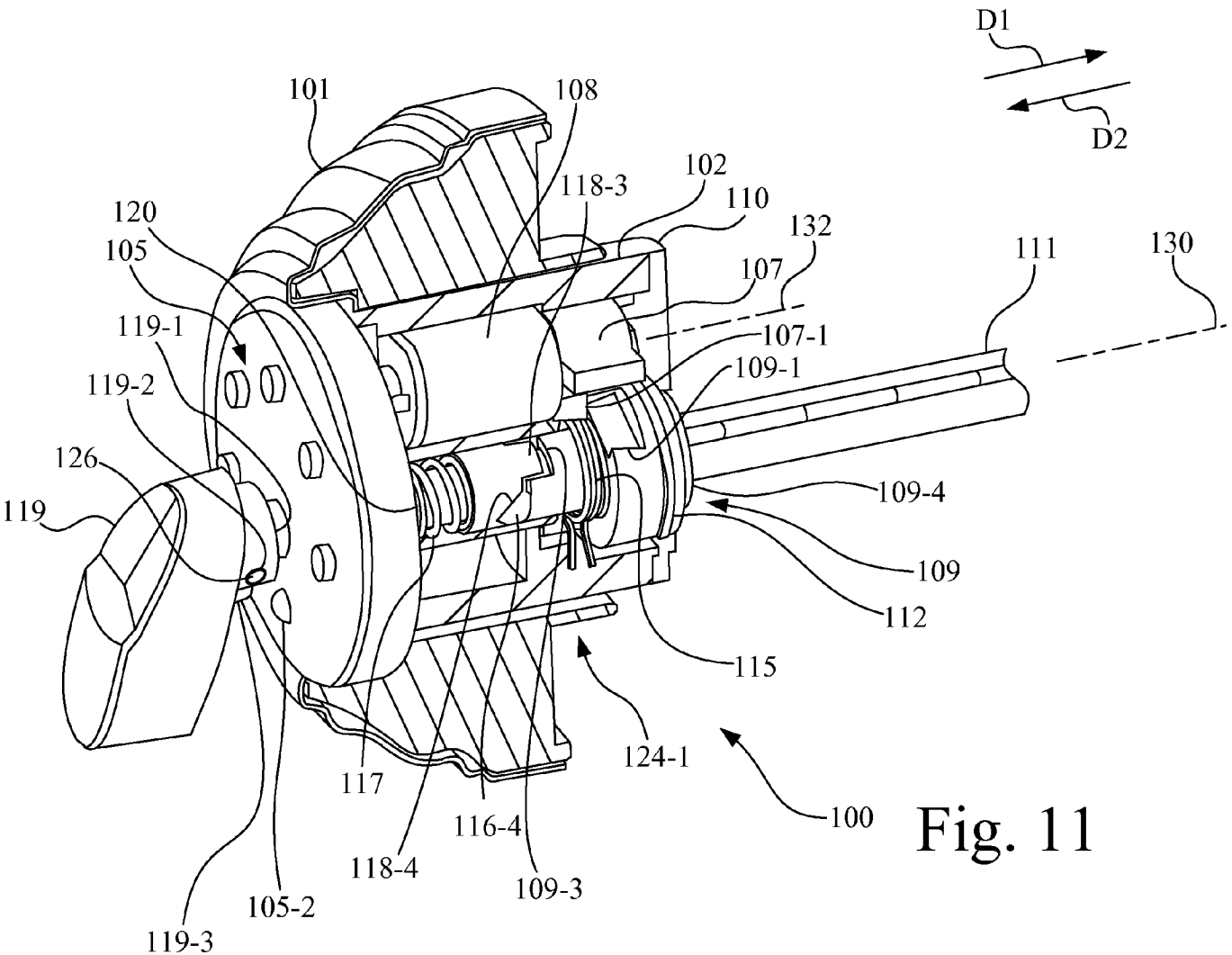
FIG. 11 is a partial section view of the exterior actuator assembly of FIGS. 4-8, with the locking shifter retracted to the unlocked position, and with the turnpiece rotated to effect rotation of the torque blade driver for actuation of the standard deadbolt/latch bolt mechanism of FIG. 1.

Thus, when turnpiece 119 is rotated (see FIG. 11), for example clockwise, within a predetermined range of motion, e.g., less than 90 degrees, the torque blade driver 109 and torque blade 111 are rotated, which in turn retracts the deadbolt 28 of deadbolt mechanism 18 (see FIG. 1). When the user releases turnpiece 119, the torsion spring 115 will return the torque blade driver 109 to the home position 115-3 (see FIG. 10), and in turn rotate the turnpiece 119 counterclockwise to its pre-actuated position.

Referring to FIGS. 9 and 10, turnpiece 119 includes a protruding pin 119-3 configured to engage a button 105-2 on keypad 105. Thus, turnpiece 119, which is spring biased outwardly by turnpiece spring 121 (see FIG. 7) in direction D2, may be axially depressed in direction D1 to bring the protruding pin 119-3 into contact with the button 105-2 so as to actuate the button 105-2. The button 105-2 may be used, for example, as system "wakeup" command input for the control circuit; as an "enter" key for the code entered by the user on keypad 105; and/or as an illumination switch to turn on a light source to aid in code entry on keypad 105.

Figure 14:
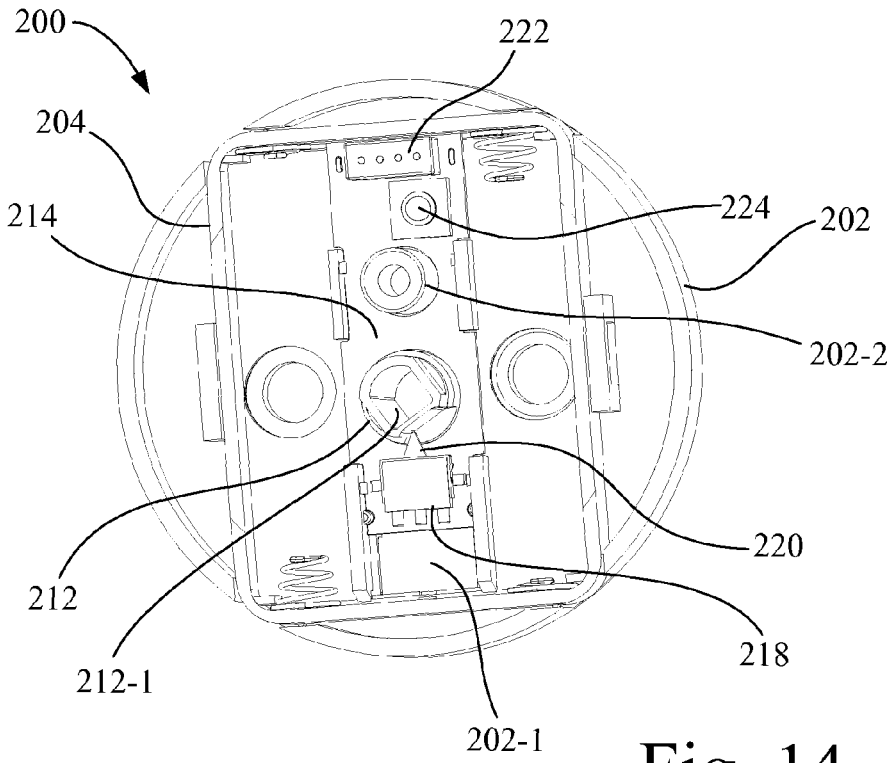
FIG. 14 is an interior rear view of the interior actuator assembly of FIGS. 2 and 3, with the batteries removed.
Figure 15:
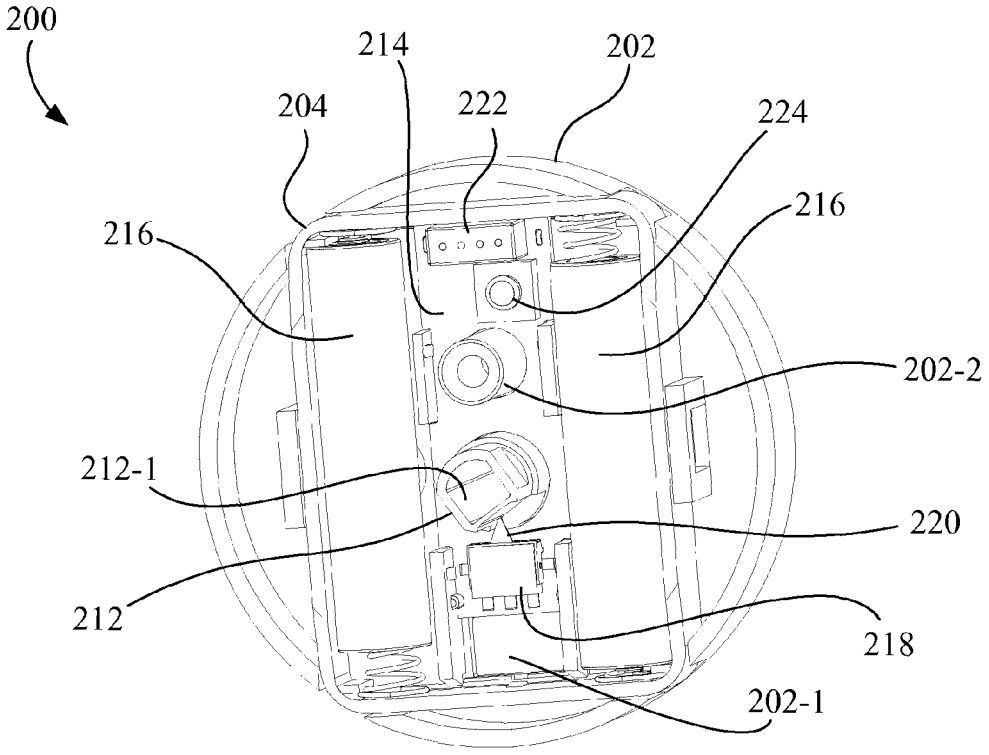
FIG. 15 is an interior rear view of the interior actuator assembly of FIGS. 2 and 3, with the batteries installed.
Figure 16:
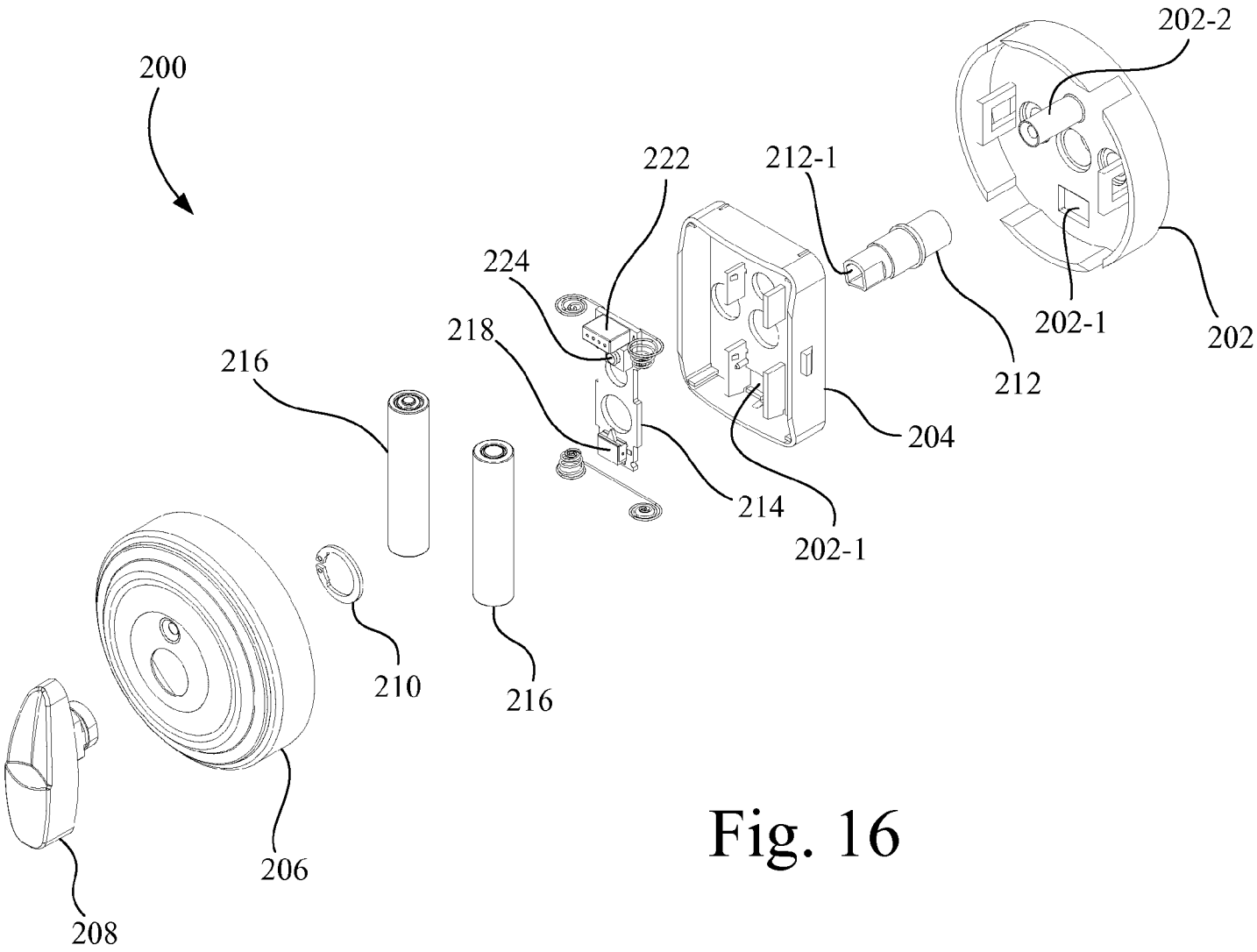
FIG. 16 is an exploded view of the interior actuator assembly of FIGS. 2, 3, 14, and 15.

Referring to FIGS. 14-16 in conjunction with FIGS. 1-3, there is shown more detailed views of interior actuator assembly 200, which is suitable for use in conjunction with exterior actuator assembly 100, described above.

Interior actuator assembly 200 is configured to operate deadbolt mechanism 18 from the secured space 16 via interior turnpiece 208. More particularly, cover 206 has an opening for mounting interior turnpiece 208 via a ring retainer 210 to thus be rotatably mounted to interior cover 206. Interior torque blade driver 212 is drivably attached to interior turnpiece 208. Interior actuator assembly 200 is configured in a fail-safe manner to provide a continuous drive via interior turnpiece 208 through torque blade 111 to selectively retract and extend retractable deadbolt 28 of deadbolt mechanism 18 by a rotation of interior turnpiece 208. In other words, interior turnpiece 208 is always drivably connected to deadbolt mechanism 18 to operate retractable deadbolt 28.

As shown in FIGS. 14-16, a battery holder 204 is attached to interior base 202. Battery holder 204 mounts an interior chassis 214, which may be in the form of a printed circuit board 214. Battery holder 204 is configured to accommodate two AAA batteries 216 which provide electrical power to all electrical components of both interior actuator assembly 200 and the exterior actuator assembly 100. Battery holder 204 is snapped into position on interior base 202.

Interior chassis 214 includes a switch 218 having a protruding actuator 220, a wiring connector 222, and a programming button 224. Actuator 220 of switch 218 is positioned to be selectively actuated by a camming action caused by a rotation of interior torque blade driver 212. Interior rose (base) 202 has a wiring channel 202-1 for receiving a wiring harness from exterior actuator assembly 100, described above, which in turn is electrically coupled to wiring connector 222. Interior rose (base) 202 has a single post 202-2 for mounting the cover 206 via a screw.

In FIGS. 14 and 15, the switch 218/actuator 220 is shown in the closed condition with the interior turnpiece 208 and interior torque blade driver 212 rotatably positioned in the locked condition, and as such the motor 108 is electrically disengaged. Switch 218 may be configured, for example, as a normally open switch. When the switch 218 changes state, from closed to open by rotation of interior turnpiece 208 to the unlocked condition, the control logic of the printed circuit board 104 of the exterior actuator assembly causes the motor 108 to unlock, i.e., to move the locking shifter 107 to the unlocked position (see FIGS. 9 and 10). When the switch 218 is in the open state (unlocked position) the motor 108 and locking shifter 107 remains in the unlocked position, but motor 108 is electrically disengaged and thus does not use any power.

Programming button 224 is provided to allow the programming of the memory 104-5 of printed circuit board 104 of the exterior actuator assembly 100 with a plurality of unique user access codes.

During operation, a valid access code is entered on the keypad 105 to permit the unlocking of the deadbolt mechanism 18 via exterior turnpiece 119. When the access code is entered, the user has a period of time, e.g., 5 to 10 seconds, in which to rotate exterior turnpiece 119 to unlock the deadbolt mechanism 18. After the period of time, the motor 108/locking shifter 107 is returned back to the locked condition, as illustrated in FIG. 9.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An exterior actuator assembly for a manually driven electronic deadbolt assembly and configured to operate a deadbolt mechanism from an exterior space via a torque blade, the exterior actuator assembly having a locked condition and an unlocked condition, the exterior actuator assembly comprising:

a cylinder body;

an exterior turnpiece rotatably mounted to the cylinder body;

a torque blade driver coupled to the torque blade, the torque blade driver having a perimetrical lock recess, the torque blade driver being rotatable about a first rotational axis;

a clutch assembly drivably interposed between the exterior turnpiece and the torque blade driver;

a motor having a motor shaft arranged to rotate about a second rotational axis that is non-coaxial with the first rotational axis; wherein the first and second rotational axes are substantially parallel to each other;

a locking shifter mounted to the cylinder body and configured for axial translation along the second rotational axis, the locking shifter having a blocking tab portion configured for selective engagement with the perimetrical lock recess of the torque blade driver;

a rotational-to-linear motion converter drivably interposed between the motor shaft and the locking shifter and configured such that a rotation of the motor shaft in a first rotational direction about the second rotational axis results in an axial displacement of the locking shifter in a first longitudinal direction to a locked position corresponding to the locked condition wherein the blocking tab portion of the locking shifter is engaged with the perimetrical lock recess of the torque blade driver to prohibit rotation of the torque blade via the exterior turnpiece, and a rotation of the motor shaft in a second rotational direction about the second rotational axis results in an axial displacement of the locking shifter in a second longitudinal direction to an unlocked position corresponding to the unlocked condition wherein the blocking tab portion of the locking shifter is disengaged from the perimetrical lock recess of the torque blade driver to permit rotation of the torque blade via the exterior turnpiece;

a turnpiece clutch shaft having a proximal end and a distal end, the exterior turnpiece being mounted to the turnpiece clutch shaft at the proximal end, and having an annular groove intermediate of the proximal end and the distal end, and having a pair of opposed V-shaped ramps spaced toward the distal end from the annular groove;

a turnpiece clutch driver having a bore for receiving the turnpiece clutch shaft, the turnpiece clutch driver having a pair of opposed V-shaped slots configured to receive the pair of opposed V-shaped ramps of the turnpiece clutch shaft, the turnpiece clutch driver having a circumferential tab configured to drivably engage the torque blade driver;

a retaining ring positioned in the annular groove; and a clutch spring interposed between the retaining ring and the turnpiece clutch driver, the clutch spring configured to bias the turnpiece clutch driver such that the pair of opposed V-shaped slots of turnpiece clutch driver engage the pair of opposed V-shaped ramps of the turnpiece clutch shaft.

2. The exterior actuator assembly of claim 1, further comprising:

a keypad configured to receive a user input code entered by a user; and a control circuit electrically connected to the motor, the control circuit configured to receive the user input code and discriminate between a valid input code and an invalid input code entered by the user via the keypad.

3. The exterior actuator assembly of claim 2, the control circuit being configured such that when a valid input code is entered at the keypad the input code is converted into a command to shift the locking shifter in the second longitudinal direction to the unlocked position such that the torque blade is rotatable by rotation of the exterior turnpiece.

4. The exterior actuator assembly of claim 3, wherein the control circuit of the exterior actuator assembly is configured such that when in the locked condition and a valid input code corresponding to one of a plurality of unique user access codes is entered on the keypad to attain the unlocked condition at the exterior actuator assembly, the user has a predetermined period of time in which to rotate the exterior turnpiece, and if the exterior turnpiece is not rotated during the predetermined period of time, at the expiration of the predetermined period of time the exterior actuator assembly is returned back to the locked condition.

5. The exterior actuator assembly of claim 2, further comprising a programming button configured to allow programming of a memory of the control circuit of the exterior actuator assembly with a plurality of unique user access codes via the keypad.

6. The exterior actuator assembly of claim 2, wherein the exterior turnpiece includes a protruding pin and the keypad has a corresponding button, the exterior turnpiece being spring biased outwardly by a turnpiece spring away from the button of the keypad, and configured such that a manual pressing of the exterior turnpiece causes the protruding pin to engage the corresponding button of the keypad to actuate the button to initiate an action.

7. The exterior actuator assembly of claim 6, wherein the action is a system "wakeup" command input for the control circuit.

8. The exterior actuator assembly of claim 6, wherein the action is one of an "enter" key for the code entered by the user on the keypad and an illumination switch to turn on a light source to aid in code entry on the keypad.

9. The exterior actuator assembly of claim 1, the clutch assembly being configured such that a relative rotation between the turnpiece clutch driver and the turnpiece clutch shaft causes the pair of opposed V-shaped slots of the turnpiece clutch driver to ride up the pair of opposed V-shaped ramps of the turnpiece clutch shaft, thereby causing a proximal axial movement of turnpiece clutch driver toward the proximal end of the turnpiece clutch shaft, thereby causing the circumferential tab of the turnpiece clutch driver to disengage from the torque blade driver, so as to prevent damage to the exterior actuator assembly if the turnpiece is forcibly rotated when the torque blade driver is blocked from rotation.

10. A manually driven electronic deadbolt assembly for use on a door separating an exterior space from a secured space, comprising:

a deadbolt mechanism having a spindle drive opening;

a torque blade configured to be drivably received in the spindle drive opening of the deadbolt mechanism, the torque blade having a first end, a second end, and a first rotational axis;

an interior actuator assembly configured to operate the deadbolt mechanism from the secured space, the interior actuator being mechanically connected to the first end of the torque blade; and an exterior actuator assembly configured to operate the deadbolt mechanism from the exterior space, the exterior actuator assembly having a locked condition and an unlocked condition, the exterior actuator assembly including:

a cylinder body;

an exterior turnpiece rotatably mounted to the cylinder body;

a torque blade driver coupled to the second end of the torque blade, the torque blade driver having a perimetrical lock recess;

a clutch mechanism drivably interposed between the exterior turnpiece and the torque blade driver;

a motor having a motor shaft arranged to rotate about a second rotational axis that is non-coaxial with the first rotational axis;

a locking shifter mounted to the cylinder body and configured for axial translation along the second rotational axis, the locking shifter having a blocking tab portion configured for selective engagement with the perimetrical lock recess of the torque blade driver;

a rotational-to-linear motion converter drivably interposed between the motor shaft and the locking shifter and configured such that a rotation of the motor shaft in a first rotational direction about the second rotational axis results in an axial displacement of the locking shifter in a first longitudinal direction to a locked position corresponding to the locked condition wherein the blocking tab portion of the locking shifter is engaged with the perimetrical lock recess of the torque blade driver to prohibit rotation of the torque blade via the exterior turnpiece, and a rotation of the motor shaft in a second rotational direction about the second rotational axis results in an axial displacement of the locking shifter in a second longitudinal direction to an unlocked position corresponding to the unlocked condition wherein the blocking tab portion of the locking shifter is disengaged from the perimetrical lock recess of the torque blade driver to permit rotation of the torque blade via the exterior turnpiece;

wherein the first and second rotational axes are substantially parallel to each other;

an interior turnpiece;

an interior base to which is attached a battery holder and a cover, the cover having an opening for mounting the interior turnpiece;

an interior torque blade driver drivably attached to the interior turnpiece, the interior torque blade driver having a shaped opening for drivably receiving the first end of the torque blade;

an interior printed circuit board mounted to the battery holder, the interior printed circuit board having a switch having a protruding actuator, and having a wiring connector, the actuator being positioned to be selectively actuated by a camming action caused by a rotation of the interior torque blade driver, the switch having a first state and a second state; and a wiring harness extending from the control circuit of the exterior actuator assembly to the wiring connector of the printed circuit board of the interior actuator assembly and configured such that when the switch is in the first state by a rotation of the interior turnpiece to unlock the deadbolt mechanism, the control logic of the control circuit causes the exterior actuator assembly to attain the unlocked condition.

11. The manually driven electronic deadbolt assembly of claim 10, further comprising:

a keypad configured to receive a user input code entered by a user; and a control circuit electrically connected to the motor, the control circuit configured to receive the user input code and discriminate between a valid input code and an invalid input code entered by the user via the keypad.

12. The manually driven electronic deadbolt assembly of claim 11, the control circuit being configured such that when a valid input code is entered at the keypad the input code is converted into a command to shift the locking shifter in the second longitudinal direction to the unlocked position such that the torque blade is rotatable to operate a bolt of the deadbolt mechanism.

13. The manually driven electronic deadbolt assembly of claim 12, wherein the control circuit of the exterior actuator assembly is configured such that when in the locked condition and a valid input code corresponding to one of a plurality of unique user access codes is entered on the keypad to attain the unlocked condition at the exterior actuator assembly, the user has a predetermined period of time in which to rotate the exterior turnpiece, and if the exterior turnpiece is not rotated during the predetermined period of time, at the expiration of the predetermined period of time the exterior actuator assembly is returned back to the locked condition.

14. The manually driven electronic deadbolt assembly of claim 10, the clutch assembly including:

a turnpiece clutch shaft having a proximal end and a distal end, the exterior turnpiece being mounted to the turnpiece clutch shaft at the proximal end, and having an annular groove intermediate of the proximal end and the distal end, and having a pair of opposed V-shaped ramps spaced toward the distal end from the annular groove;

a turnpiece clutch driver having a bore for receiving the turnpiece clutch shaft, the turnpiece clutch driver having a pair of opposed V-shaped slots configured to receive the pair of opposed V-shaped ramps of the turnpiece clutch shaft, the turnpiece clutch driver having a circumferential tab configured to drivably engage the torque blade driver;

a retaining ring positioned in the annular groove; and a clutch spring interposed between the retaining ring and the turnpiece clutch driver, the clutch spring configured to bias the turnpiece clutch driver such that the pair of opposed V-shaped slots of turnpiece clutch driver engage the pair of opposed V-shaped ramps of the turnpiece clutch shaft.

15. The manually driven electronic deadbolt assembly of claim 14, the clutch assembly being configured such that a relative rotation between the turnpiece clutch driver and the turnpiece clutch shaft causes the pair of opposed V-shaped slots of the turnpiece clutch driver to ride up the pair of opposed V-shaped ramps of the turnpiece clutch shaft, thereby causing a proximal axial movement of turnpiece clutch driver toward the proximal end of the turnpiece clutch shaft, thereby causing the circumferential tab of the turnpiece clutch driver to disengage from the torque blade driver, so as to prevent damage to the exterior actuator assembly if the turnpiece is forcibly rotated when the torque blade driver is blocked from rotation.

16. The manually driven electronic deadbolt assembly of claim 10, wherein when the switch is in the first state the motor is electrically disengaged by the control logic of the control circuit after the unlocked condition is attained.

17. The manually driven electronic deadbolt assembly of claim 10, further comprising a programming button located at the interior actuator assembly configured to allow the programming of a memory of the control circuit of the exterior actuator assembly with a plurality of unique user access codes via the keypad.

18. A method for operating a deadbolt mechanism mounted on a door that separates an exterior space from a secured space, the deadbolt mechanism having a spindle drive opening, the method comprising:

providing a torque blade configured to be drivably received in the spindle drive opening of the deadbolt mechanism, the torque blade having a first end, a second end, and a first rotational axis;

providing an interior actuator assembly for operating the deadbolt mechanism from the secured space, the interior actuator being mechanically connected to the first end of the torque blade; and providing an exterior actuator assembly for operating the deadbolt mechanism from the exterior space, the exterior actuator assembly having a locked condition and an unlocked condition, the exterior actuator assembly including:

a cylinder body;

an exterior turnpiece rotatably mounted to the cylinder body;

a torque blade driver coupled to the second end of the torque blade, the torque blade driver having a perimetrical lock recess;

a clutch mechanism drivably interposed between the exterior turnpiece and the torque blade driver;

a motor having a motor shaft arranged to rotate about a second rotational axis that is non-coaxial with the first rotational axis;

a locking shifter mounted to the cylinder body and configured for axial translation along the second rotational axis, the locking shifter having a blocking tab portion configured for selective engagement with the perimetrical lock recess of the torque blade driver;

a rotational-to-linear motion converter drivably interposed between the motor shaft and the locking shifter and configured such that a rotation of the motor shaft in a first rotational direction about the second rotational axis results in an axial displacement of the locking shifter in a first longitudinal direction to a locked position corresponding to the locked condition wherein the blocking tab portion of the locking shifter is engaged with the perimetrical lock recess of the torque blade driver to prohibit rotation of the torque blade via the exterior turnpiece; wherein the first and second rotational axes are substantially parallel to each other; and a rotation of the motor shaft in a second rotational direction about the second rotational axis results in an axial displacement of the locking shifter in a second longitudinal direction to an unlocked position corresponding to the unlocked condition wherein the blocking tab portion of the locking shifter is disengaged from the perimetrical lock recess of the torque blade driver to permit rotation of the torque blade via the exterior turnpiece;

a keypad configured to receive a user input code entered by a user;

a control circuit electrically connected to the motor, the control circuit configured to receive the user input code and discriminate between a valid input code and an invalid input code entered by the user via the keypad; and wherein the exterior turnpiece includes a protruding pin and the keypad has a corresponding button, the exterior turnpiece being spring biased outwardly by a turnpiece spring away from the button of the keypad, and configured such that a manual pressing of the exterior turnpiece causes the protruding pin to engage the corresponding button of the keypad to actuate the button to initiate an action.

* * * * *